US005343622A

United States Patent [19]

Andrews

[11] Patent Number: 5,343,622

[45] Date of Patent: Sep. 6, 1994

[54] BI-DIRECTIONAL RAZOR DEVICE

[76] Inventor: Edward A. Andrews, 6835 Beach Rd., Troy, Mich. 48098

[21] Appl. No.: 20,594

[22] Filed: Feb. 22, 1993

[51] Int. Cl.[5] ..... B26B 21/00; B26B 21/14

[52] U.S. Cl. ..... 30/50; 30/84

[58] Field of Search ..... 30/34, 35, 36, 42, 50, 30/84, 299

[56] References Cited

U.S. PATENT DOCUMENTS

| | | | |
|---|---|---|---|
| 3,488,764 | 1/1970 | Welsh | 30/50 |
| 4,302,876 | 12/1981 | Emmett | 30/50 |
| 4,501,066 | 2/1985 | Sceberras | 30/50 |
| 4,601,392 | 7/1986 | Althaus | 30/84 |
| 4,663,843 | 5/1987 | Savage | 30/50 |

*Primary Examiner*—Richard K. Seidel

*Assistant Examiner*—Paul M. Heyrana, Sr.

*Attorney, Agent, or Firm*—Harness, Dickey & Pierce

[57] ABSTRACT

A bi-directional razor device is formed of a narrow, elongated head and a transversely extending, integral hand grip formed of molded plastic material. Two pair of narrow, strip-like razor blades are embedded in the head, with one pair extending in one direction and the other pair extending in an opposite direction at an acute angle relative to the first pair. The blades extend along the length of the head. Thus, the user may move the razor head in one direction for contacting one pair of blades against the user's skin for cutting hair and then move the handle in the opposite direction while the blades remain engaged upon the skin for cutting hair in both directions.

5 Claims, 1 Drawing Sheet

BI-DIRECTIONAL RAZOR DEVICE

BACKGROUND OF INVENTION

Conventional razors are typically made with either one or a pair of parallel strip-like razor blades secured upon the head of the razor. A handle extends from the head. The user holds the handle and ordinarily scraps or moves the head in one direction along the skin for cutting the hair. After each movement in one direction, when the stroke is completed, the user lifts the razor and brings it back to a point near the original starting position for a second stroke in the same direction. Thus, the conventional razors are uni-directional in operation.

Razors have also been made in which blades mounted upon their heads extend in opposite directions. However, these razors have the blades spaced apart and angled so that they are essentially unidirectional devices. That is, first one blade is used and later the user turns the razor 180 degrees to present the opposite blade towards the skin. The use of a bi-directional razor blade mounted within the head of a razor is common so as to provide the user with twice the blade life, i.e., once for each sharp edge in unidirectional shaving.

However, in many instances, it would be desirable to have a bi-directional razor for more rapidly and efficiently shaving the user's face or arms or legs. That is, it would be convenient to provide a razor construction which is useable for stroking first in one direction and then stroking backwards in the reverse direction for reducing the time and effort in shaving. This invention is concerned with providing such a bi-directional razor blade system.

DESCRIPTION OF INVENTION

This invention contemplates a bi-directional razor, formed of molded plastic material, having an elongated, narrow head and a depending handle. Pairs of parallel, closely spaced, single edge, strip-like razor blades are embedded in the head. The strips of one pair of blades have their sharpened edges extending in one direction along the edge of the head while the strips opposite pair have their sharpened edges extending in an opposite direction, that is, at an acute angle relative to the first pair of blades. Thus, the user may grasp the handle and slide the razor, for example, downwardly along the facial skin so that one pair of blades scrape the skin and cut the hair in one direction. Then, the user may move the handle in the opposite direction, for example, upwardly for cutting the hair in the upward direction.

It is contemplated to provide a razor blade system which may cut in either direction of movement by the user, simply by moving the handle back-and-forth for engaging either one or the other of the pairs of blades with the skin.

An object of this invention is to provide a simplified razor construction which cuts hair in opposite directions of movement by the user merely by manually moving the handle of the razor in opposite directions relative to the skin.

Other objects and advantages of this invention will become apparent upon reading the following description, of which the attached drawings form a part.

DETAILED DESCRIPTION

Figure 1:
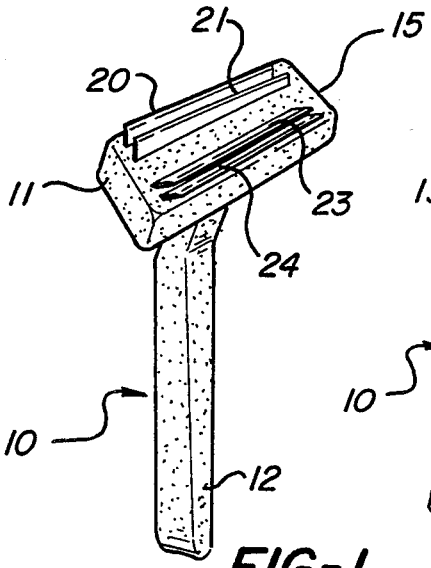
FIG. 1 is a perspective view of the bi-directional razor.
Figure 2:
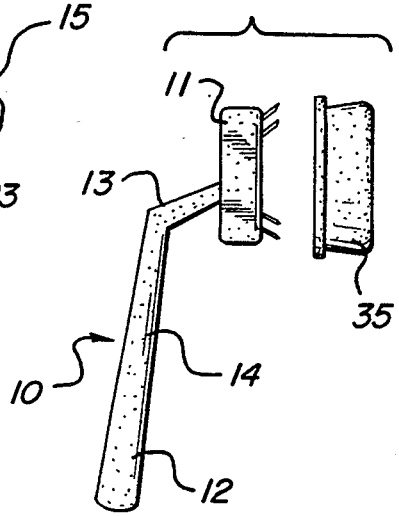
FIG. 2 is a side elevational view of the razor with a cover arranged next to the head of the razor.

FIG. 1 illustrates, in perspective, the bi-directional razor 10. The razor is preferably formed of any suitable molded plastic material to provide a head 11 and an integral hand grip or handle 12. The hand grip may have an upper end portion 13 which is molded integrally with the head and a lower, angled hand holding portion 14. Alternatively, the handle may be shaped in a more curved or in a more straight configuration.

The head 11 is in the shape of an elongated, narrow strip or bar. It is provided with a substantially flat, exposed shaving face 15. By way of example, the face may be about ⅜ to ½ inch in width and about 1½ inch in length and about 3/16 inch in thickness. These dimensions may vary considerably, but in general it can be seen that the head is in the form of a narrow, generally rectangular shape.

The head is provided with a first pair of razor blades 20 and 21 and an oppositely, angularly extending, second pair of razor blades 23 and 24. The blades are each formed of a narrow, single edge razor blade strip. Each blade strip has an inner portion 26, which is embedded within the head, and an outer, sharpened edge, portion 27 or **27*a* which extends outwardly from the head for cutting hair. The sharpened edges, preferably, are arranged so that edges 27 cut in one direction while edges 27*a*** cut in the opposite direction. Thus, when one pair of edges cut, the other pair merely drags or rides upon the skin and guides the edges that cut. As shown schematically in the drawings, the blades of each pair are closely adjacent to each other, such as on the order of 1/32 to 1/16 inch. The spacings may be varied, as desired, however.

Preferably, each of these blades is formed of a conventional, single edge razor blade which may be made of stainless steel strip or sintered metal, such as a hard carbide, or the like conventional razor blade material. These blades may be embedded in the head of the razor during the molding of the razor head or, alternatively, may be separately formed and inserted in slots or sockets provided in the molded head for the purpose of receiving the blades. The blades may be fastened in their sockets by the molding of plastic around them, or adhesively or by some suitable mechanical fastening means. Significantly, the two opposing pairs of blades are close to each other, and extend outwardly at an acute angle relative to each other. The blades extend along almost the entire length of the narrow head of the razor.

Figure 3:
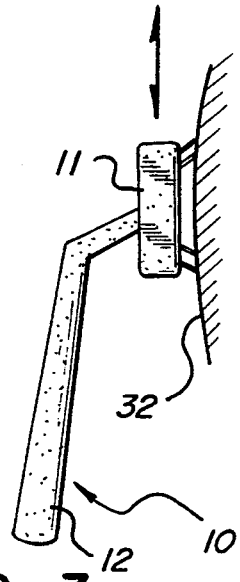
FIG. 3 is a side elevational view, schematically showing the razor engaging the user's skin and ready to move either upwardly or downwardly for shaving.
Figure 4:
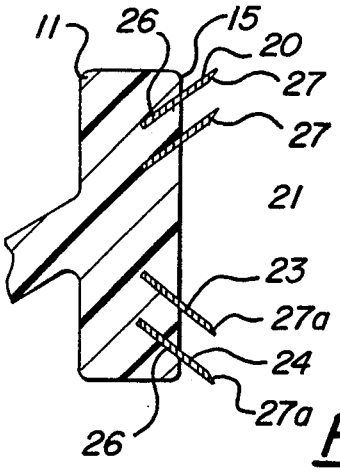
FIG. 4 is an enlarged, cross-sectional view, showing the razor head and blades in cross-section.
Figure 5:
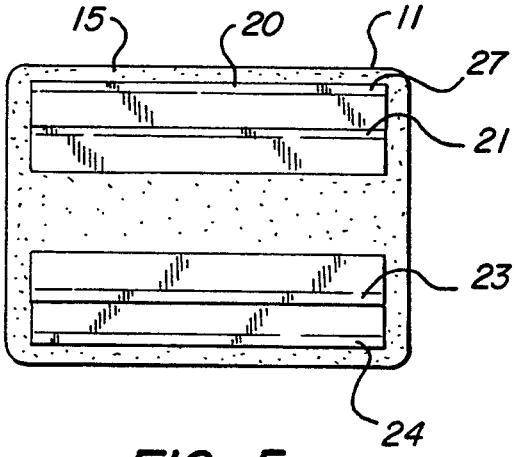
FIG. 5 is a plan view of the face of the razor head shown in FIG. 4.

In use, as illustrated in FIG. 3, the razor is applied against the user's skin 32 (shown schematically) and is moved back-and-forth. By way of example, when the razor is moved upwardly, as schematically shown in FIG. 3, the sharp edges 27 of one pair of blades 20 and 21 engage the skin and cut the hair in the upward direction. Then, the user may move the handle downwardly so that the sharp edges 27*a* of the second pair of razor blades 23 and 24 cut the hair without lifting the razor head away from the skin.

The razor may be used in almost any direction when shaving legs or the sides of faces, etc. The terms upwardly and downwardly are used here to describe the bi-directional operation wherein the razor may be stroked in one direction and then reversed to stroke in the opposite direction.

Figure 6:
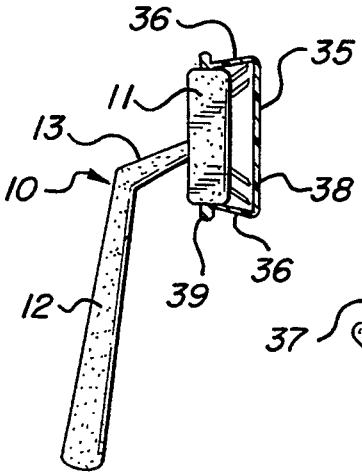
FIG. 6 is an elevational view of the razor illustrated in FIG. 2, with its cover, shown in cross-section, frictionally attached over the head.
Figure 7:
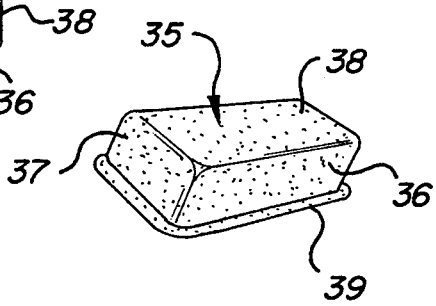
FIG. 7 is a perspective view of the removable cover, per se.

Preferably, the razor is provided with a removable cover or cap 35 as illustrated in FIGS. 6 and 7. This cover is formed of a molded plastic trough shape having opposing sidewalls 36, end walls 37 and a base 38. It may also have an edge head 39 for stiffening it, if desired. The cover snugly fits over the head of the razor and is attached thereto by friction. The cover is so dimensioned so that it may be manually pushed over the head and will remain in place under the force of friction. Conversely, the cover may be manually pulled off the head.

The precise shape of the cap may vary, depending upon the shape and size of the head. Thus, the cover is schematically illustrated as being shaped to fit over the blades and engage the sides of the head. The cover may be formed of a transparent plastic material.

Figure 8:
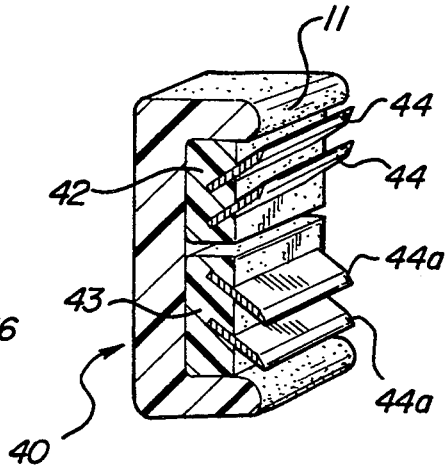
FIG. 8 is an enlarged, cross-sectional, perspective view of a modified head of the razor.

FIG. 8 illustrates a modified razor head 40 which is similar to head 11 shown in FIGS. 1–5. However, the face 41 of the head is provided with a pair of razor blade cartridges 42 and 43 each having a pair of blades 44 and 44*a*. The shapes of the cartridges vary. The cartridges may be suitably fastened upon the head, as for example, they may be arranged within a depression closely formed in the head and held therein by friction, so that, their outer surfaces are approximately in the same plane.

Although two pairs of blades are preferred, the razor may be formed with either two single blades or with two triple sets of blades. The construction and operation may otherwise be similar to that described above.

This invention may be further developed within the scope of the following claims. Accordingly, it is desired that the foregoing description be read as being merely illustrative of an operative embodiment of this invention and not in a strictly limiting sense.

Having fully described at least one operative embodiment of this invention, I now claim:

1. A bi-directional razor comprising a single unitary elongated, narrow, strip-like razor head formed of molded plastic material, and having an elongated narrow exposed face, said head having an overall generally rectangular shape with a first and second longitudinal edge and a longitudinal axis;

an elongated, narrow, molded plastic hand grip having a single end formed integral with the head between the opposite ends of the head and extending transversely of the head and said face;

a first, elongated, thin, narrow razor blade strip extending along the length of the head and having an inner portion embedded in the head and an integral, sharpened outer, elongated edge portion extending outwardly of the face at an acute angle relative to the face and projecting toward the first longitudinal edge away from the longitudinal axis;

a second, elongated, thin, narrow razor blade strip substantially identical in size and shape to the first razor blade strip extending along the length of the head and having an elongated inner portion embedded in the head and an integral, sharpened outer, elongated edge portion extending outwardly of the face at an acute angle to the face and projecting toward the second longitudinal edge away from the longitudinal axis and at an acute angle relative to the first blade, so that the two blades extend in generally opposite directions towards their respective first and second edge;

said blade edges being in a single flat plane generally parallel to said razor head;

the razor hand grip being adapted for manually grasping and for moving the hand grip and the head in one direction along the user's skin for cutting hair extending therefrom and then for reversing the direction of movement of hand grip for moving the head in the opposite direction along the user's skin for cutting hair extending therefrom without lifting, tilting or repositioning the head from the user's skin during movements in the opposite directions;

whereby the user of the razor may slide the razor back and forth in his own normal manner of moving a conventional razor upon his skin without changing his manner of holding the handgrip during the back and forth sliding movement upon his skin.

2. A razor as defined in claim 1, and including said blade sharpened edge portions being in a plane which is roughly parallel to the plane of said face so that the hand grip may be selectively moved in opposite directions for engaging either one blade or the other blade with the user's skin, depending upon the direction of movement of the razor relative to the user's skin.

3. A razor as defined in claim 2, and including an elongated trough shaped cover of a size and shape to snugly fit over the head for covering the face and blades and for frictionally gripping the head for removably fastening the cover on the head.

4. A bi-directional razor as defined in claim 1, and including a third and a fourth blade, each substantially identical in size and shape to the first and second blades, with the third blade arranged closely adjacent to, and parallel to, the first blade and having its inner portion embedded in the head adjacent the inner portion of the first blade and its outer sharpened edge portion arranged parallel to, but spaced a short distance from the sharpened edge of the first blade, so that the first and third blades cut hair simultaneously as the razor is moved in one direction along the user's skin;

and with the fourth blade arranged closely adjacent to, and parallel to, the second blade and having its inner portion embedded in the head closely adjacent to the inner portion of the second blade and its outer, sharpened edge portion arranged parallel to, and closely spaced from the sharpened edge of the second blade, so that the second and fourth blades cut hair simultaneously as the razor is moved in a cutting direction along the user's skin, whereby the razor may cut first in one direction and then in the opposite direction by manually moving the hand grip and without lifting the head away from the user's skin.

5. A bi-directional razor as defined in claim 4, and including said blade sharpened edges being in the plane which is roughly parallel to the plane of the exposed face of the head so that the hand grip may be selectively moved in opposite directions for engaging either one pair of blades or the other pair of blades with the user's skin, depending upon the direction of movement of the razor relative to the user's skin.

* * * * *